US011946250B2

(12) United States Patent
DePaul

(10) Patent No.: US 11,946,250 B2
(45) Date of Patent: Apr. 2, 2024

(54) CEILING SYSTEM AND METHOD OF INSTALLATION

(71) Applicant: ARMSTRONG WORLD INDUSTRIES, INC., Lancaster, PA (US)

(72) Inventor: Marie A. DePaul, Downingtown, PA (US)

(73) Assignee: AWI Licensing LLC, Wi, DE (US)

( * ) Notice: Subject to any disclaimer, the term of this patent is extended or adjusted under 35 U.S.C. 154(b) by 0 days.

(21) Appl. No.: 17/409,369

(22) Filed: Aug. 23, 2021

(65) Prior Publication Data

US 2022/0056690 A1 Feb. 24, 2022

Related U.S. Application Data

(60) Provisional application No. 63/069,368, filed on Aug. 24, 2020.

(51) Int. Cl.

| | |
|---|---|
| ***E06B 9/34*** | (2006.01) |
| ***E04B 1/84*** | (2006.01) |
| ***E04B 9/00*** | (2006.01) |
| ***E04B 9/04*** | (2006.01) |
| ***E04B 9/12*** | (2006.01) |
| ***E04B 9/22*** | (2006.01) |
| ***E04B 9/34*** | (2006.01) |

(52) U.S. Cl.

CPC ..... *E04B 9/345* (2013.01); *E04B 1/84* (2013.01); *E04B 9/001* (2013.01); *E04B 9/0407* (2013.01); *E04B 9/122* (2013.01); *E04B 9/225* (2013.01); *E04B 2001/8414* (2013.01); *E04B 2001/8423* (2013.01)

(58) Field of Classification Search

CPC ..... E04B 9/0407; E04B 9/061; E04B 9/345; E04B 9/366; E04B 9/18; E04B 9/22; E04B 9/225; E04B 1/84

See application file for complete search history.

(56) References Cited

U.S. PATENT DOCUMENTS

| | | | | |
|---|---|---|---|---|
| 1,445,401 A | | 2/1923 | Lachman | |
| 2,639,011 A | * | 5/1953 | Peterson | E04B 9/345 52/668 |

(Continued)

FOREIGN PATENT DOCUMENTS

| | | |
|---|---|---|
| CN | 107386516 A | 11/2017 |
| CN | 210288842 U | 4/2020 |

(Continued)

*Primary Examiner* — Kyle J. Walraed-Sullivan
(74) *Attorney, Agent, or Firm* — Patrick Sheldrake

(57) ABSTRACT

A ceiling system is provided for use in a building space. The ceiling system has an open cell grid structure and is attached to a support structure of the building via hanging hardware. The open cell grid structure is constructed of a plurality of first panels attached to the hanging hardware, a plurality of second panels attached to the plurality of first panels, and a plurality of third panels attached to the plurality of second panels. The first, second, and third panels are attached via a plurality of slots which allow secure engagement and utilize gravity to retain them in the assembled condition. Beneficially, the plurality of second panels and the plurality of third panels are free of hanging hardware.

20 Claims, 10 Drawing Sheets

(56) References Cited

U.S. PATENT DOCUMENTS 2,689,026 A * 9/1954 Zingone ..... F21V 11/06 362/148
3,050,162 A * 8/1962 Zingone ..... E04B 9/345 52/666
3,378,980 A * 4/1968 Blitzer, Jr. ..... F21V 11/06 D26/121
3,544,787 A * 12/1970 Audeval ..... E04B 9/345 362/354
4,471,596 A 9/1984 Deaton
4,532,749 A * 8/1985 Perk ..... E04B 9/345 52/668
4,545,165 A * 10/1985 Carey ..... E04B 9/345 52/506.07
4,658,562 A * 4/1987 Brugman ..... E04B 9/34 52/665
8,839,590 B1 9/2014 Kortman
9,598,864 B1 3/2017 Hulka
11,377,845 B2 * 7/2022 Ahmadi ..... E04B 9/34
2002/0078653 A1 * 6/2002 Jean ..... E04B 9/345 446/124
2014/0166836 A1 * 6/2014 Kabatsi ..... E04B 9/00 248/317
2015/0068135 A1 * 3/2015 Waters ..... E04B 9/366 52/39
2018/0127976 A1 * 5/2018 Gillette ..... E04B 9/045
2020/0002942 A1 * 1/2020 Headley ..... E04B 9/001
2020/0018066 A1 * 1/2020 Kaump ..... F21V 11/00
2020/0123772 A1 * 4/2020 Adams ..... E04B 9/0407
2020/0208811 A1 * 7/2020 Ross ..... G02B 6/0073
2021/0324627 A1 * 10/2021 Bixel ..... E04B 9/10

FOREIGN PATENT DOCUMENTS

JP H06-027418 B2 4/1994
JP H08-165742 A 6/1996
JP H09-13572 A 1/1997

* cited by examiner

CEILING SYSTEM AND METHOD OF INSTALLATION

CROSS-REFERENCE TO RELATED APPLICATIONS

This application claims the benefit of U.S. Provisional Application No. 63/069,368, filed on Aug. 24, 2020. The disclosure of the above application(s) is (are) incorporated herein by reference.

BACKGROUND

Many types of ceiling systems exist. Ceiling systems comprising a hanging grid of acoustic panels or individual hanging panels have become increasingly popular in recent years. These systems can be used to provide noise absorption without completely covering the structure of the room or building. "Islands" of hanging panels can provide a desirable aesthetic appearance while simultaneously providing or exceeding the benefits of more traditional drop ceiling systems. These systems require that the panels be hung from a support structure. Installation can be time consuming and expensive. Therefore, a need exists for improved ceiling systems which make installation easier and reduce the complexity of the hanging systems.

SUMMARY

Embodiments of the invention provide a solution to the above problem by allowing more flexibility in grid design and more flexibility in ceiling tile construction and arrangement.

In one aspect, the invention can be a ceiling system having an open cell grid structure and hanging hardware. The open cell grid structure has a plurality of first panels, each of the first panels having a first top edge, a first bottom edge, and a plurality of first upper slots in the first top edge. The first panels are arranged in a non-intersecting arrangement so that the first bottom edges face downward. The open cell grid structure further has a plurality of second panels, each of the second panels having a second top edge, a second bottom edge, a plurality of second upper slots in the second top edge, and a plurality of second lower slots in the second bottom edge that are offset from the second upper slots. The second panels are mounted to the first panels in a first intersecting arrangement so that the second lower slots mate with the first upper slots to form primary intersection nodes, the second bottom edges facing downward. The open cell grid structure also has a plurality of third panels, each of the third panels having a third top edge, a third bottom edge, and a plurality of third lower slots in the third bottom edge. The third panels are mounted to the second panels in a second intersecting arrangement so that the third lower slots mate with the second upper slots at secondary intersection nodes, the third bottom edges facing downward. The hanging hardware is connected to each of the first panels and to a support structure to hang the open cell grid structure from the support structure in an occupied space of a building.

In another aspect, the invention can be a method of installing a ceiling system in a building. The method starts with hanging a plurality of first panels in a non-intersecting arrangement from an overhead support with hanging hardware. Each of the first panels has a first top edge, a first bottom edge, and a plurality of first upper slots in the first top edge, the first bottom edges facing downward. Second, a plurality of second panels are mounted to the first panels in a first intersecting arrangement by mating second lower slots of the second panels with the first upper slots of the first panels to form primary intersection nodes. The second lower slots are formed in second bottom edges of the second panels that face downward. Third, a plurality of third panels are mounted to the second panels in a second intersecting arrangement by mating third lower slots of the third panels with second upper slots of the second panels to form secondary intersection nodes. The third lower slots are formed in third bottom edges of the third panels that face downward. The second upper slots are formed in second top edges of the second panels, thereby forming an open cell grid structure that hangs in an occupied space of the building.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
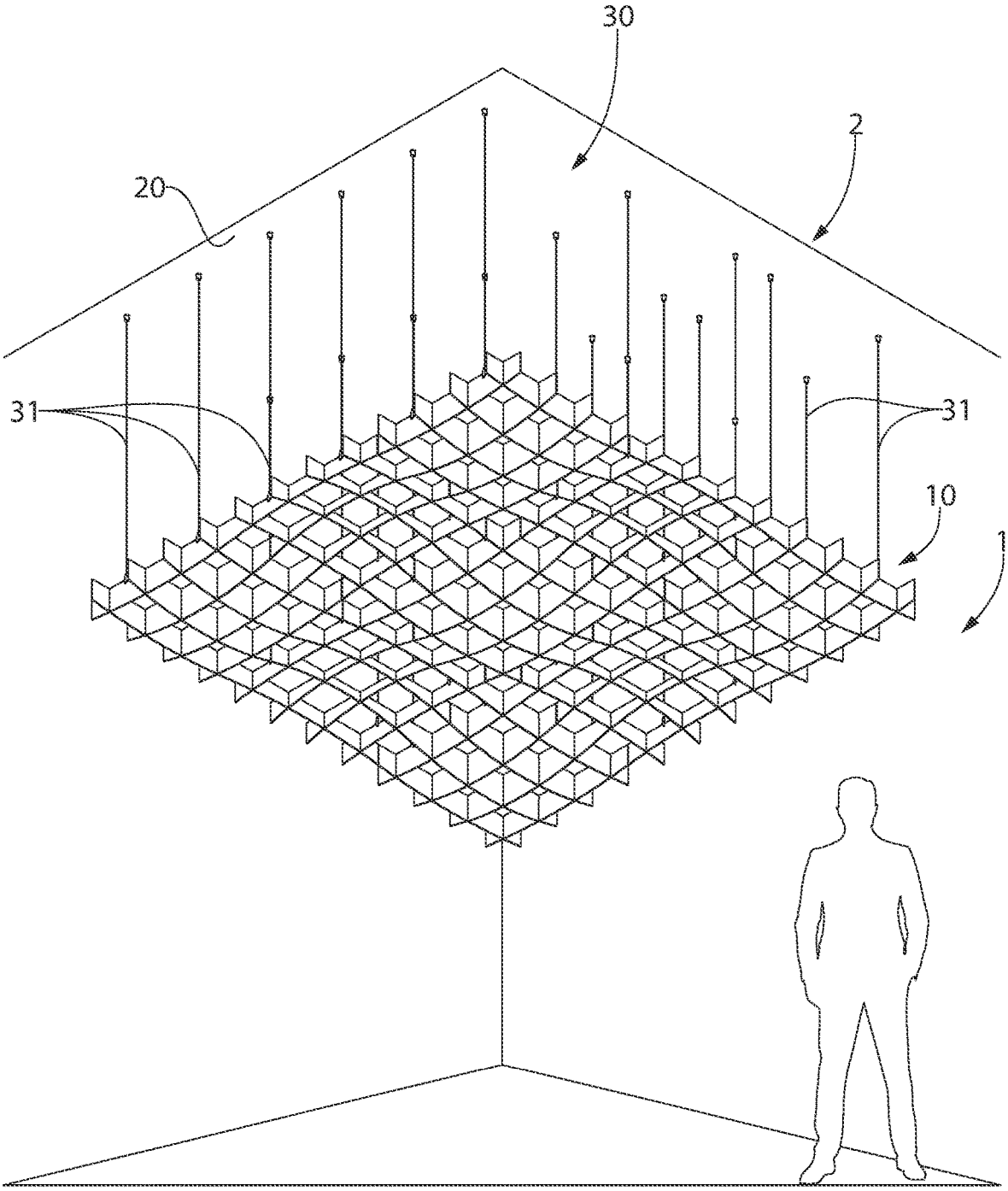
FIG. 1 is a perspective view of an occupied space in a building, the ceiling system installed in the occupied space.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

FIG. 1 shows an occupied space 1 in a building 2. A ceiling system 10 is attached to a support structure 20 such as the building's roof, trusses, or other structure forming an interior of the building 2. The ceiling system 10 is attached to the support structure 20 via hanging hardware 30. The ceiling system 10 forms a floating island structure that is not directly connected to any walls within the building 2. Instead, the ceiling system 10 is exclusively connected to the support structure 20, the ceiling support structure 20 being a roof, roof trusses, ceiling, or ceiling structural members of the interior of the building 2. The hanging hardware 30 may comprise wire, rods, or any other tensile member capable of supporting the components of the ceiling system 10. In one embodiment the hanging hardware 30 is a plurality of individual tensile members 31, each tensile member 31 comprising a first hook attached to the support structure 20, a wire connected to the first hook, and a second hook connected to the wire and to a panel of the ceiling system 10. The number of tensile members 31 utilized to support the ceiling system 10 depends on a variety of factors including the area covered by the ceiling system 10, the strength of the ceiling system 10 and the strength of the support structure 20, the availability of suitable connection points on the support structure 20, and a variety of other factors.

Figure 2:
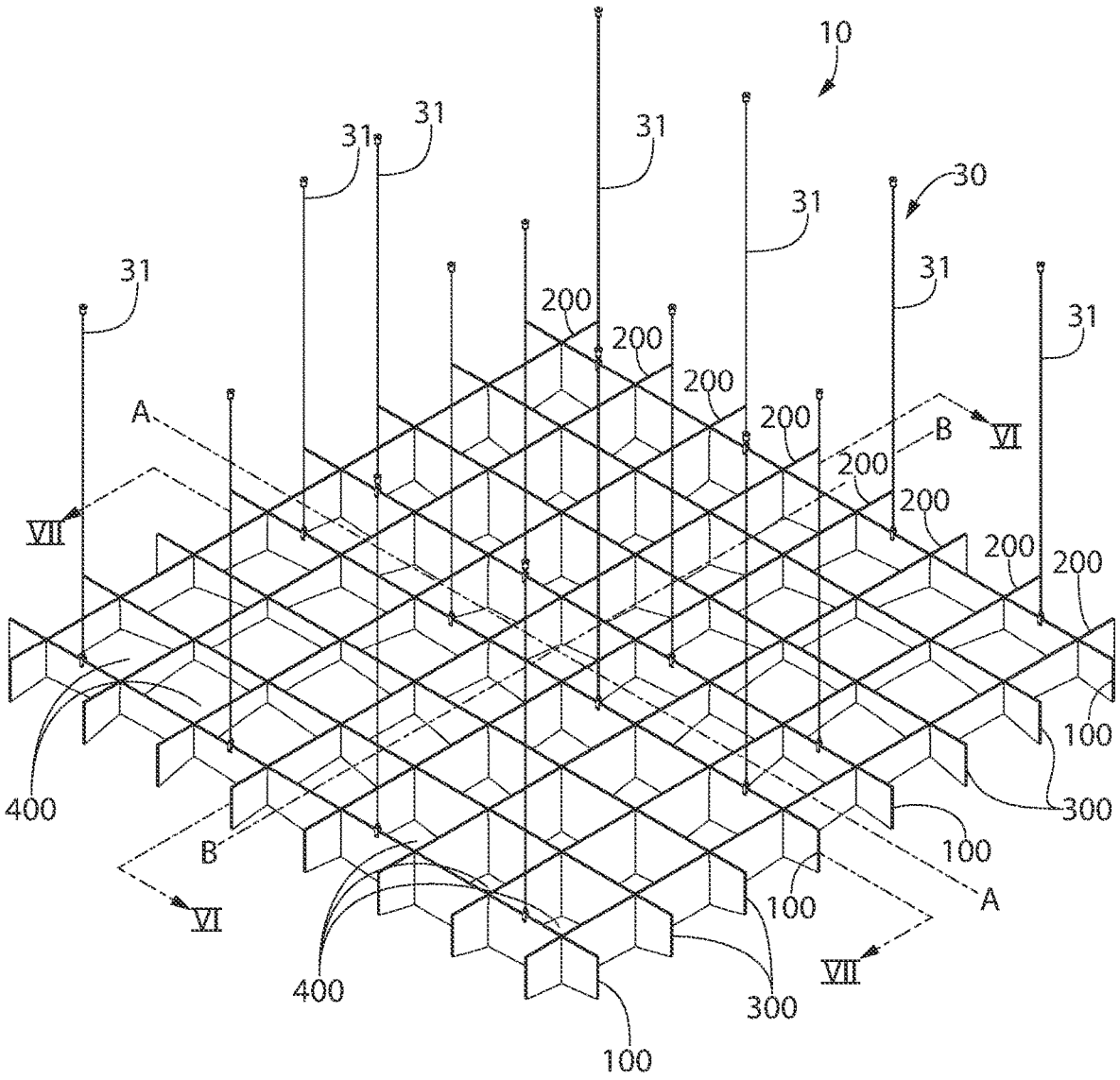
FIG. 2 is a perspective view of the ceiling system of FIG. 1.

FIG. 2 shows the ceiling system 10 in greater detail. The ceiling system 10 has a plurality of first panels 100, a plurality of second panels 200, and a plurality of third panels 300. The plurality of first panels 100 are arranged such that they are substantially parallel to a first axis A-A and do not intersect with other ones of the first panels 100. Each of the first panels 100 is attached to the support structure 20 via one or more tensile members 31 of the hanging hardware 30 and hang downward due to the force applied by gravity. The plurality of second panels 200 extend substantially parallel to the second axis B-B such that each one of the second panels 200 does not intersect other ones of the second panels 200. Each of the plurality of second panels 200 are free of tensile members 31.

Each of the plurality of second panels 200 do intersect the plurality of first panels 100. The first axis A-A is substantially perpendicular to the second axis B-B. As a result, the plurality of first panels 100 is substantially perpendicular to the plurality of second panels 200. The plurality of third panels 300 are substantially parallel to other ones of the plurality of third panels 300 and substantially parallel to the plurality of first panels 100. The plurality of third panels 300 are also substantially parallel to the first axis A-A. The plurality of third panels 300 do not intersect other ones of the plurality of third panels 300 or any of the plurality of first panels 100. Each of the plurality of third panels 300 are free of tensile members 31. In other embodiments, the second axis B-B may not be perpendicular to the first axis A-A.

As can be seen, the pluralities of first, second, and third panels 100, 200, 300 form a rectilinear grid. A plurality of open cells 400 are formed between the pluralities of first, second, and third panels 100, 200, 300. Ideally, the open cells 400 are of substantially equal cross-sectional area. In other embodiments, the open cells 400 may be of different cross-sectional area. The open cells 400 are ideally rectangular or square in shape, but may also take other shapes.

In the preferred embodiment, the plurality of first panels 100 comprise a first end first panel 100, a second end first panel 100, and a pair of central first panels 100 adjacent one another and located between the first and second end first panels 100. At least one third panel 300 is located between the first end first panel 100 and the pair of central first panels 100. At least one third panel 300 is also located between the second end first panel 100 and the pair of central first panels 100. Preferably, two third panels 300 are located between the first end first panel 100 and the pair of central first panels 100. In addition, two third panels 300 are preferably located between the second end first panel 100 and the pair of central first panels 100.

Figure 3:
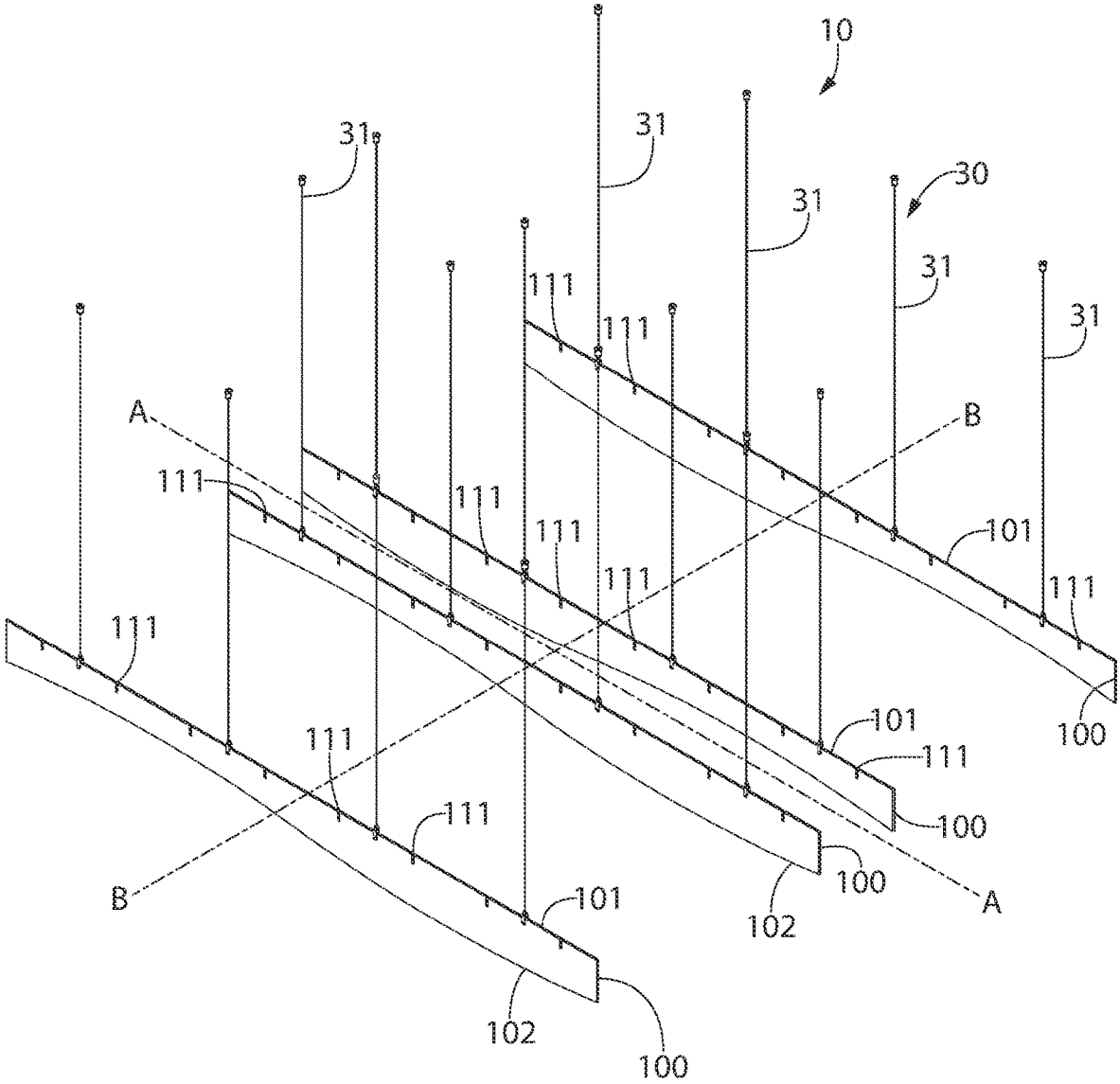
FIG. 3 is a perspective view of the first panels of the ceiling system of FIG. 1 during installation of the first panels.
Figure 4:
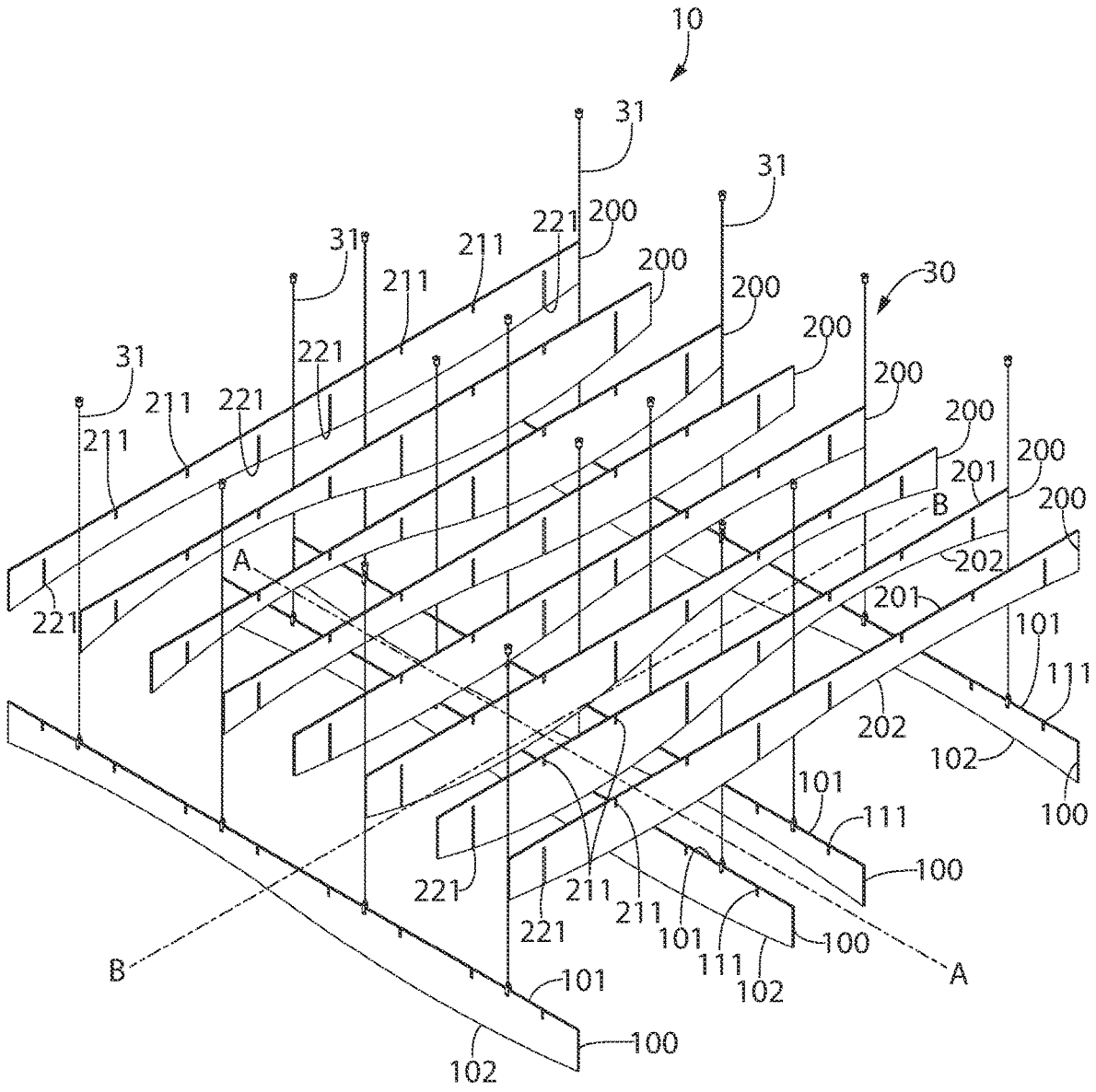
FIG. 4 is a perspective view of the first and second panels of the ceiling system of FIG. 1, the second panels being positioned to permit assembly with the first panels.
Figure 5:
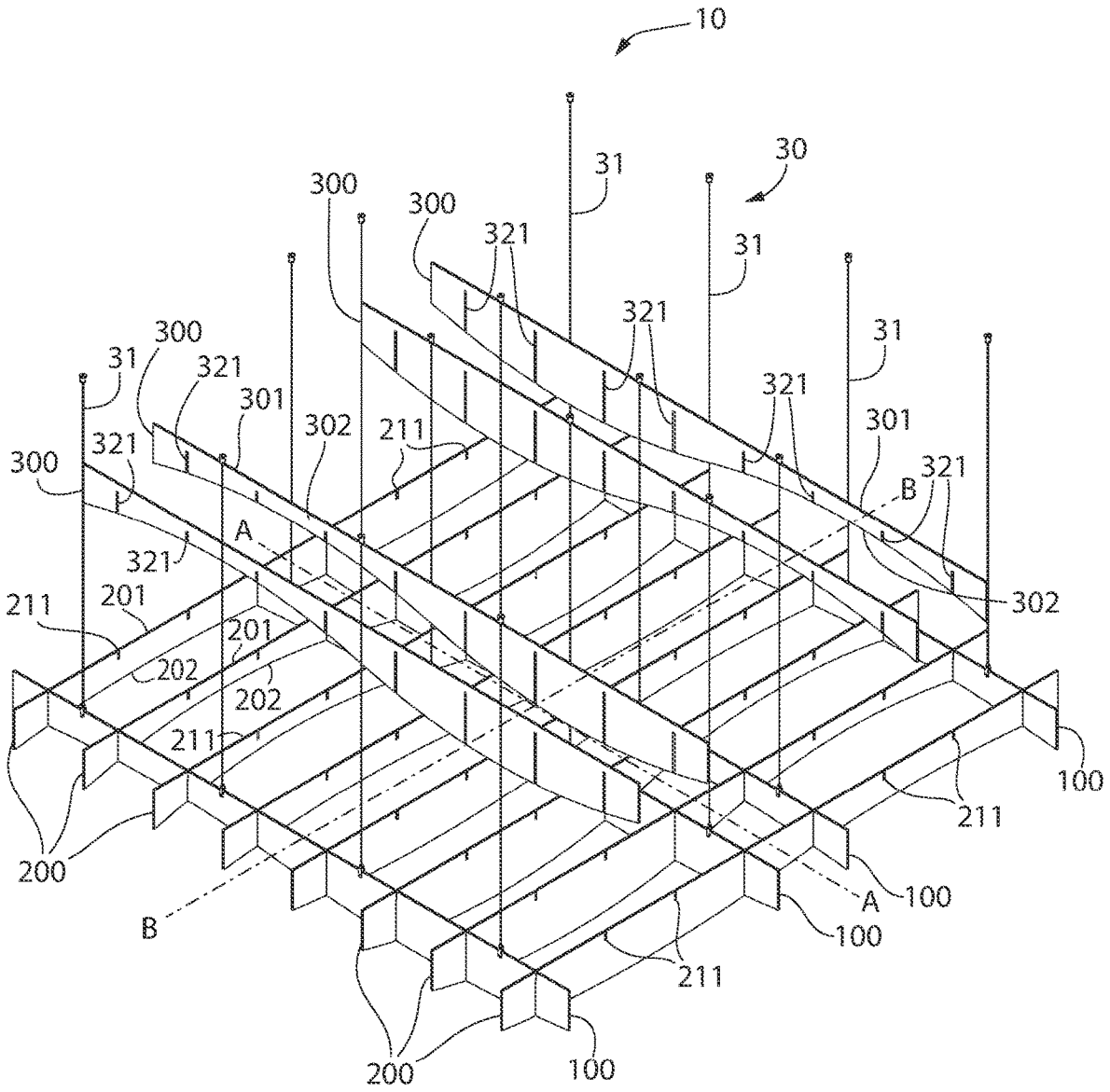
FIG. 5 is a perspective view of the first, second, and third panels of the ceiling system of FIG. 1, the third panels being positioned to permit assembly with the second panels.

FIGS. 3-5 show the ceiling system 10 in various states of assembly. FIG. 3 shows the plurality of first panels 100 installed in a first step. The plurality of first panels 100 are installed to the hanging hardware 30, with a plurality of tensile members 31 attached to each of the first panels 100. As discussed above, the plurality of first panels 100 are arranged in a non-intersecting and substantially parallel arrangement. Each of the first panels 100 have a first top edge 101, a first bottom edge 102, and a plurality of first upper slots 111 in the first top edge 101. Each of the first bottom edges 102 of the plurality of first panels 100 extend downward. Gravity ensures that the plurality of first panels 100 hang downward and are retained in position as shown in FIG. 3.

FIG. 4 shows a second step of assembling the ceiling system 10. The plurality of first panels 100 are shown in their assembled position along with the plurality of second panels 200 oriented prior to installation. The plurality of second panels 200 each have a second top edge 201, a second bottom edge 202, a plurality of second lower slots 221, and a plurality of second upper slots 211. The plurality of second lower slots 221 are located on the second bottom edge 202. The plurality of second upper slots 211 are located on the second top edge 201. Each of the plurality of second panels 200 is mounted to the plurality of first panels 100 by mating the second lower slots 221 of the second panels 200 to the first upper slots 111 of the first panels 100. This results in an interlocking arrangement that forms a plurality of primary intersection nodes. The weight of the plurality of second panels 200 is then supported by the plurality of first panels 100 at the plurality of primary intersection nodes. The plurality of primary intersection nodes will be discussed in greater detail below. Gravity ensures that the plurality of second panels 200 remain interlocked with the plurality of first panels 100. No other fastening is required, although additional fasteners may be added if so desired.

FIG. 5 shows a third step of assembling the ceiling system 10. The plurality of first panels 100 are shown assembled with the plurality of second panels 200. The plurality of third panels 300 are shown oriented prior to installation. Each of the plurality of third panels 300 are oriented substantially parallel to the plurality of first panels 100. Each of the plurality of third panels 300 has a third top edge 301, a third bottom edge 302, and a plurality of third lower slots 321. The plurality of third lower slots 321 is located on the third bottom edge 302 of the third panels 300. Each of the plurality of third panels 300 is mounted to the plurality of second panels 200 by mating the third lower slots 321 of the third panels 300 to the second upper slots 211 of the second panels 200. This results in an interlocking arrangement that forms a plurality of secondary intersection nodes.

The weight of the plurality of third panels 300 is then supported by the plurality of second panels 200 at the plurality of secondary intersection nodes. The weight of the plurality of third panels 300 is carried to the plurality of first panels 100 via the primary intersection nodes formed by plurality of second panels 200 with the plurality of first panels 100. The plurality of secondary intersection nodes will be discussed in greater detail below. Gravity ensures that the plurality of third panels 300 remain interlocked with the plurality of second panels 200. No other fastening is required, although additional fasteners may be added if so desired. None of the plurality of third panels 300 is directly supported by any one of the plurality of first panels 100. Instead, the third panels 300 are spaced and isolated from the first panels 100. Preferably, each of the first, second, and third top edges 101, 201, 301 are substantially flush at the primary and secondary intersection nodes. In one embodiment, each of the first, second, and third top edges 101, 201, 301 lie in the same plane.

Figure 6:
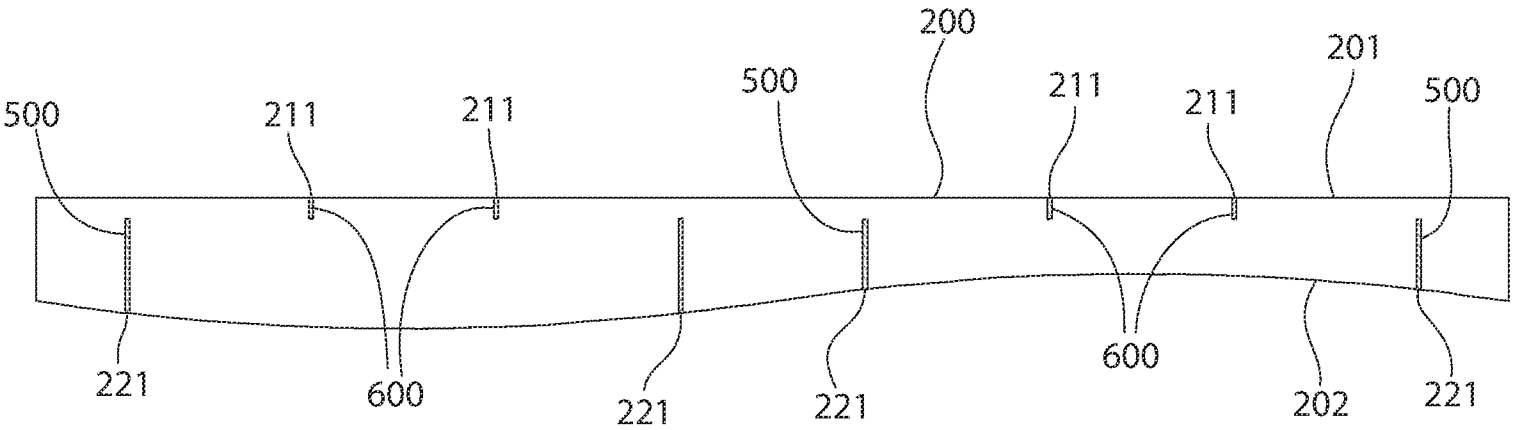
FIG. 6 is a cross-section view of the ceiling system along line VI-VI of FIG. 2.

FIG. 6 shows a cross section taken along the line VI-VI in FIG. 2 showing the primary intersection nodes 500 and secondary intersection nodes 600. The primary intersection nodes 500 are formed by the intersection of the plurality of first panels 100 with the plurality of second panels 200, with the first panels 100 engaging the second lower slots 221 at the primary intersection nodes 500. The second intersection nodes 600 are formed by the intersection of the plurality of second panels 200 with the plurality of third panels 300, with the third panels 300 engaging the second upper slots 211 of the second panels 200. Thus, the plurality of first upper slots 111 and the plurality of second lower slots 221 mate to form the first intersection nodes 500. The plurality of second upper slots 211 and the plurality of third lower slots 321 mate to form the second intersection nodes 600.

Figure 7:
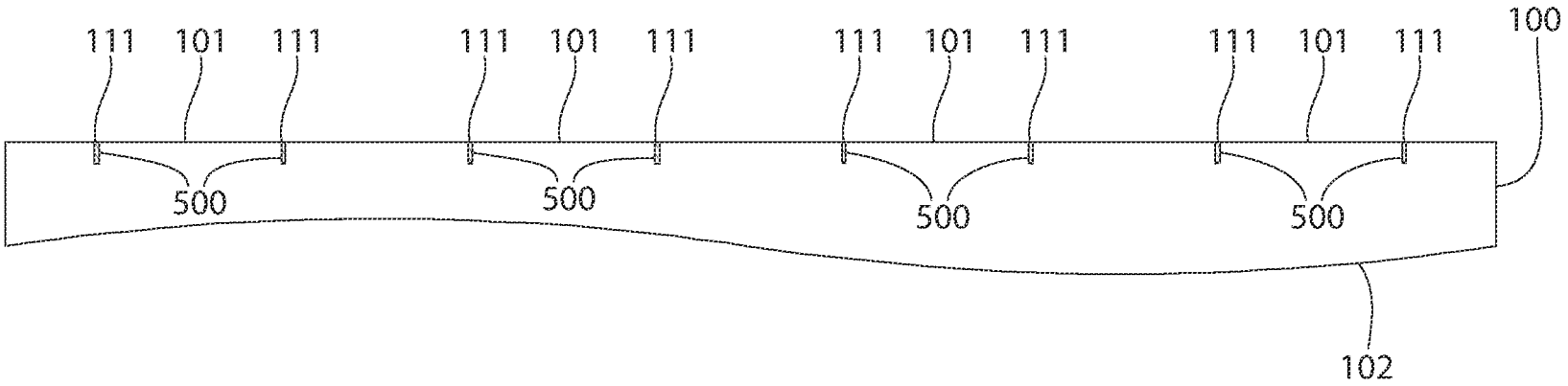
FIG. 7 is a cross-section view of the ceiling system along line VII-VII of FIG. 2

FIG. 7 shows a cross section taken along line VII-VII in FIG. 2 showing the primary intersection nodes 500 from a different perspective. One of the plurality of first panels 100 can be seen with a the plurality of primary intersection nodes 500 formed by the plurality of second panels 200 being inserted into the first upper slots 111 of the first panel 100.

Figure 8:
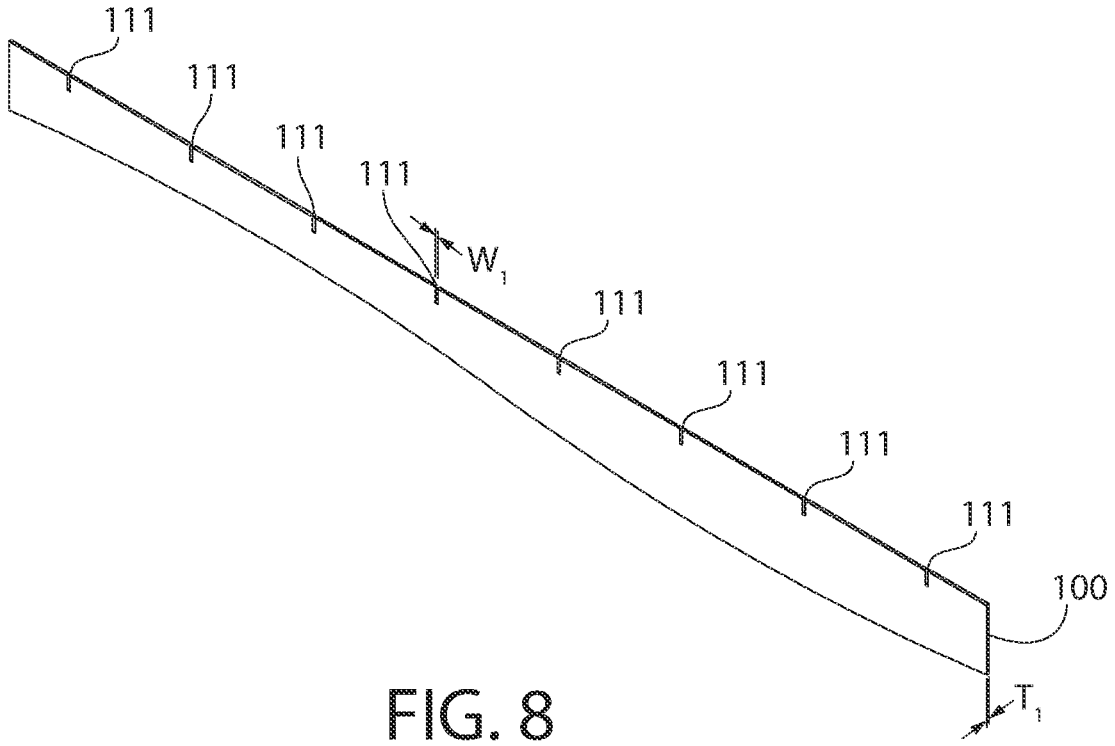
FIG. 8 is a perspective view of a first panel of the ceiling system of FIG. 1.
Figure 9:
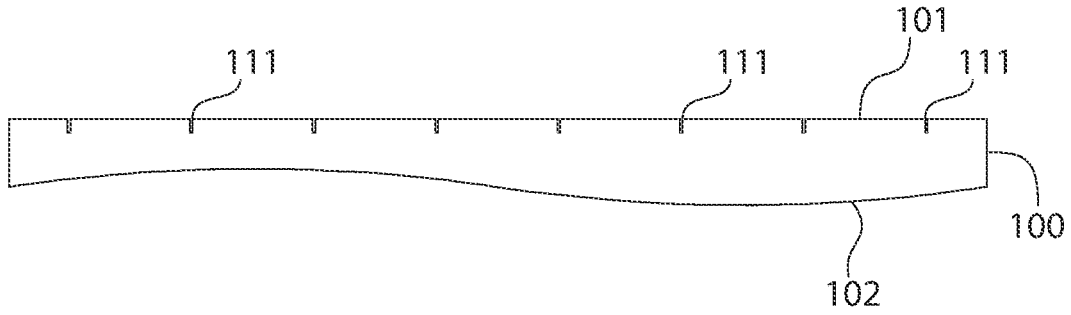
FIG. 9 is a side view of a first panel of the ceiling system of FIG. 1.

FIGS. 8 and 9 show a perspective view and a side view of one of the first panels 100. As discussed previously, the first panel 100 has a plurality of first upper slots 111, a first top edge 101, and a first bottom edge 102. The first panel 100 is free of slots on the first bottom edge 102. The first panel 100 also has a panel thickness $T_1$. As can be seen, each of the first upper slots 111 are of equal height and of equal width. However, in other embodiments, the first upper slots 111 may have different heights. Each of the first upper slots 111 have a width $W_1$. In some embodiments, the first upper slots 111 may have different widths to accommodate different thicknesses of panels. In the present embodiment, the first top edge 101 is linear or straight and the first bottom edge 102 has a curvilinear shape. Thus, the first bottom edge 102 has both convex and concave shapes. In some embodiments, the first top edge 101 may have a curvilinear shape. In yet other embodiments, the first bottom edge 102 may be linear or have a shape formed by a plurality of linear segments which are non-parallel. It is important to note that not all of the plurality of first panels 100 are necessarily identical. Indeed, in most installations the first panels 100 may have different shapes to provide a varying height along the first axis A-A and along the second axis B-B. In some embodiments, all of the first panels 100 may have the same shape on the first bottom edges 102 to provide a more uniform appearance.

Figure 10:
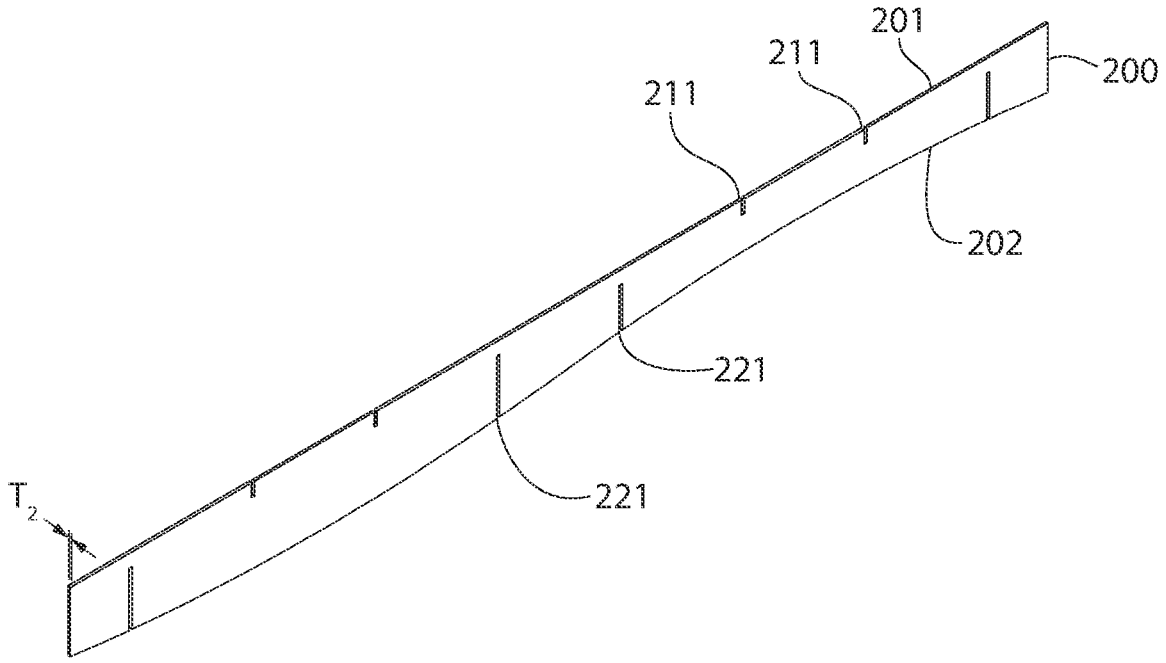
FIG. 10 is a perspective view of a second panel of the ceiling system of FIG. 1.
Figure 11:
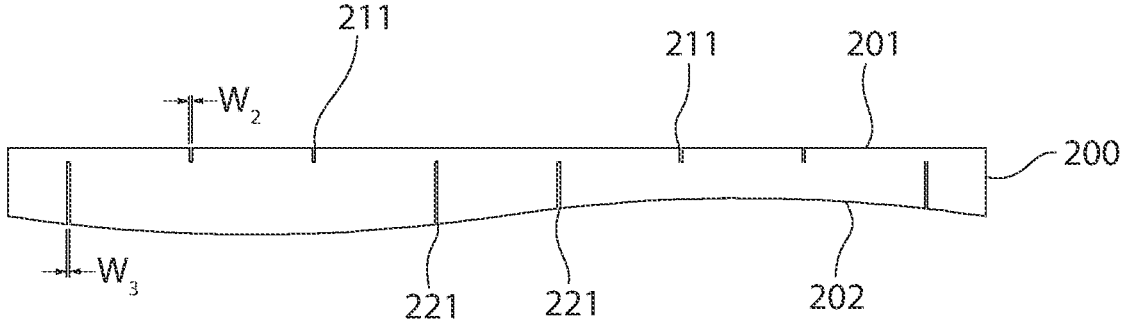
FIG. 11 is a side view of a second panel of the ceiling system of FIG. 1.

FIGS. 10 and 11 show a perspective view and a side view of one of the second panels 200. The second panel 200 has a plurality of second upper slots 211 that are equal in height and equal in width. The second panel 200 also has a plurality of second lower slots 221, the plurality of second lower slots 221 having a varying height and equal width. The second panel 200 has a panel thickness $T_2$. Each of the second upper slots 211 have a width $W_2$. Each of the second lower slots 221 have a width $W_3$. In other embodiments, the second upper slots 211 may have differing height or width and the second lower slots 221 may have equal height and differing width.

In the present embodiment, the second top edge 201 is straight and the second bottom edge 202 has a curvilinear shape comprising both convex and concave shapes. As with the first panels 100, the second top edge 201 and the second bottom edge 202 may be linear or curvilinear or have a shape formed by a plurality of linear segments which are non-parallel. As with the first panels 100, the second panels 200 need not be identical, and may vary to provide the appearance of texture as a result of the varying height of the panels 200 along both the first axis A-A and the second axis B-B. The second lower slots 221 of the present embodiment are varying in height but equal in width. This is done to compensate for the curved second bottom edge 202. By altering the height of the second lower slots 221, the second top edge 201 lies in the same plane as the first top edge 101 when the first panels 100 and the second panels 200 are assembled. In alternate configurations, the second lower slots 221 may be altered in height and the first upper slots 111 may be altered in height so that the first and second top edges 101, 201 lie in the same plane. In yet other embodiments, the first and second top edges 101, 201 may not lie in the same plane. In addition, the first bottom edge 102 and the second bottom edge 202 of each of the first and second panels 100, 200 are substantially flush at the primary intersection nodes. However, alternate configurations may have the first bottom edge 102 and the second bottom edge 202 at different heights.

Figure 12:
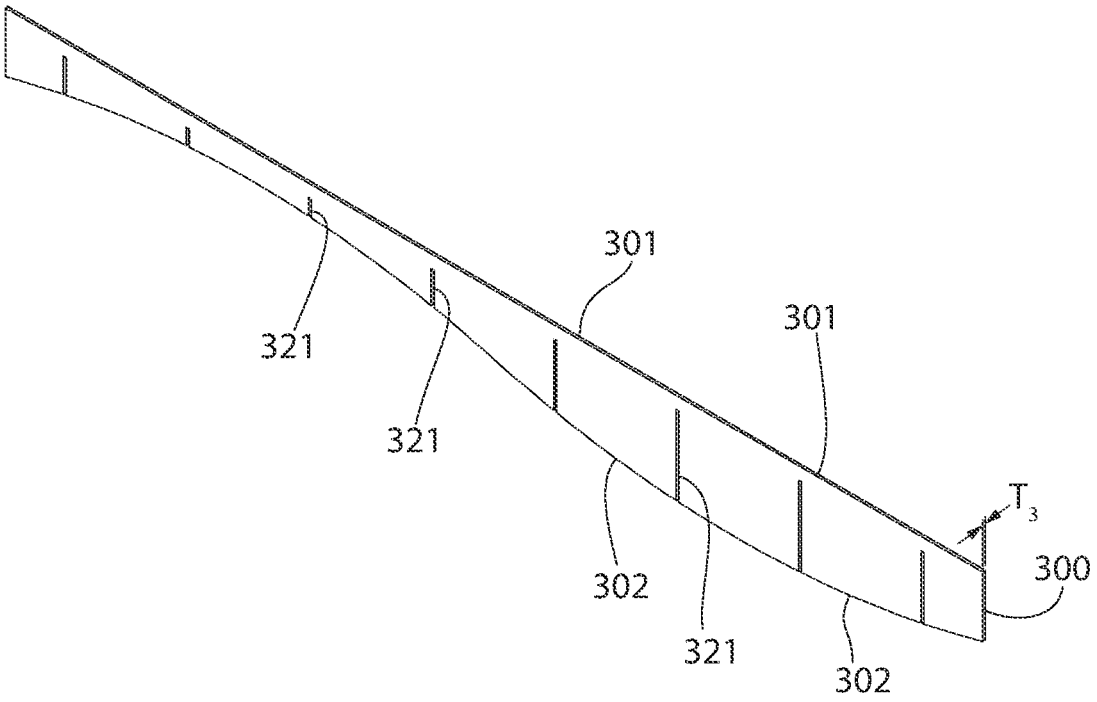
FIG. 12 is a perspective view of a third panel of the ceiling system of FIG. 1.
Figure 13:
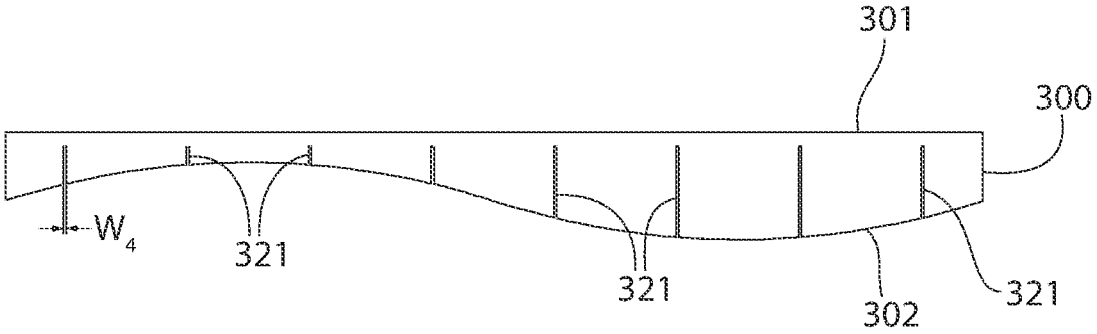
FIG. 13 is a side view of a third panel of the ceiling system of FIG. 1.

FIGS. 12 and 13 show a perspective view and a side view of one of the third panels 300. The third panel 300 has a plurality of third lower slots 321 on the third bottom edge 302 having a width $W_4$ and a plurality of unequal heights. The third top edge 301 is free of slots. As discussed above with respect to the second lower slots 221, the third lower slots 321 may be of equal height or equal width. The third panel 300 has a panel thickness $T_3$, a third top edge 301 and a third bottom edge 302. The third top edge 301 is linear and the third bottom edge 302 is curvilinear. When the third panels 300 are mated with the second panels 300, the third top edges 301 and the second top edges 201 are substantially flush at the secondary intersection nodes 600 and lie in the same plane as the first and second top edges 101, 201. The second bottom edges 202 and the third bottom edges 302 are flush at the secondary intersection nodes 600. However, in alternate embodiments the second and third top edges 201, 301 may not be flush. In alternate embodiments the second and third bottom edges 202, 302 may also not be flush. The height of the second upper slots 211 and the third bottom slots 321 may vary. The third bottom edges 302 may be curvilinear, linear or have a shape formed by a plurality of linear segments which are non-parallel. Each of the third panels 300 need not be identical.

As discussed above, different shapes of the first, second, and third panels 100, 200, 300 may be used to create a textured appearance that varies along the first axis A-A, along the second axis B-B, or along both the first and second axes A-A, B-B. As best shown in FIG. 1, the textured appearance provided by the bottom edges 102, 202, 302 can be seen in greater detail. This shape can be constructed by gradually altering the shapes of the first, second, and third bottom edges 102, 202, 303 such that the resulting ceiling system 10 has the appearance of a wave, a saw tooth, or any other shape.

Preferably, the first, second, and third panels 100, 200, 300 are acoustical panels. The panels 100, 200, 300 are preferably constructed of a sound absorbing material. The sound absorbing material may be formed into a non-woven fabric, a foam material, or other structure that provides adequate rigidity to support the weight of the assembled first, second, and third panels 100, 200, 300. In one embodiment, the panels 100, 200, 300 have sufficient rigidity that when mounted in a cantilevered fashion, a tip of a cantilevered portion of the panels 100, 200, 300 of 1 meter in length does not bend at greater than a 45 degree angle from the horizontal plane as a result of gravity. Thus, the panels 100, 200, 300 are sufficiently rigid that they do not collapse when cantilevered for a distance of 1 meter. The panels 100, 200, 300 should provide a noise reduction coefficient ("NRC") rating of at least 0.6. The panels 100, 200, 300 may be constructed of a polyester felt. Alternately, mineral wool, fiberglass, or various plastic materials may be used. Ideally, the panels 100, 200, 300 are constructed of 6.35 mm thick polyester felt material.

In the preferred embodiment, each of the panels 100, 200, 300 have the same panel thickness. Thus, the thickness $T_1$ of the plurality of first panels 100 is equal to the thickness $T_2$ of the plurality of second panels 200, which is in turn equal to the thickness $T_3$ of the plurality of third panels 300. Preferably, the widths $W_1$, $W_2$, $W_3$, $W_4$ are greater than the thicknesses $T_1$, $T_2$, $T_3$ of the panels 100, 200, 300. This ensures easy assembly of the panels 100, 200, 300 without the need to force the panels together. However, an interference fit may be used to further improve retention of the panels 100, 200, 300. Preferably, the widths $W_1$, $W_2$, $W_3$, $W_4$ are equal. However, different widths may be utilized in concert with different panel heights to provide a unique visual impression.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

EXEMPLARY CLAIM SET

Exemplary Claim 1. A ceiling system comprising: an open cell grid structure comprising: a plurality of first panels, each of the first panels having a first top edge, a first bottom edge, and a plurality of first upper slots in the first top edge, the first panels arranged in a non-intersecting arrangement so that the first bottom edges face downward; a plurality of second panels, each of the second panels having a second top edge, a second bottom edge, a plurality of second upper slots in the second top edge, and a plurality of second lower slots in the second bottom edge that are offset from the second upper slots, the second panels mounted to the first panels in a first intersecting arrangement so that the second lower slots mate with the first upper slots to form primary intersection nodes, the second bottom edges facing downward; and a plurality of third panels, each of the third panels having a third top edge, a third bottom edge, and a plurality of third lower slots in the third bottom edge, the third panels mounted to the second panels in a second intersecting arrangement so that the third lower slots mate with the second upper slots at secondary intersection nodes, the third bottom edges facing downward; hanging hardware connected to each of the first panels and to a support structure to hang the open cell grid structure from the support structure in an occupied space of a building.

Exemplary Claim 2. The ceiling system according to claim 1 wherein the second panels are supported in the open cell grid structure solely due to the mating between the first and second panels at the primary intersection nodes.

Exemplary Claim 3. The ceiling system according to any one of claims 1 to 2 wherein the third panels are supported in the open cell grid structure solely due to the mating between the second and third panels at the secondary intersection nodes.

Exemplary Claim 4. The ceiling system according to any one of claims 1 to 3 wherein the first bottom edges and the second bottom edges are substantially flush with one another at the primary intersection nodes and the second bottom edges and the third bottom edges are substantially flush with one another at the secondary intersection nodes.

Exemplary Claim 5. The ceiling system according to any one of claims 1 to 4 wherein the first panels are free of any slots on the first bottom edges, and the third panels are free of any slots on the third top edges.

Exemplary Claim 6. The ceiling system according to any one of claims 1 to 5 wherein the second and third panels are maintained in the open cell grid structure solely by gravity.

Exemplary Claim 7. The ceiling system according to any one of claims 1 to 6 wherein the third panels and the first panels do not intersect one another.

Exemplary Claim 8. The ceiling system according to claim 7 wherein the first and third panels are parallel to one another.

Exemplary Claim 9. The ceiling system according to any one of claims 1 to 8 further comprising: the first, second, and third panels have a panel thickness; and the first upper slots, the second lower slots, the second upper slots, and the third lower slots have a slot width, the slot width being greater than the panel thickness.

Exemplary Claim 10. The ceiling system according to any one of claims 1 to 9 wherein each of the first, second, and third panels are acoustical panels.

Exemplary Claim 11. The ceiling system according to any one of claims 1 to 10 wherein the each of the first, second, and third panels have an NRC rating of at least 0.6.

Exemplary Claim 12. The ceiling system according to any one of claims 1 to 11 further comprising: the first panels comprising: a first end first panel; a second end first panel; and a pair of central first panels adjacent one another and located between the first and second end first panels; and the third panels comprising: at least one of the third panels located between the first end first panel and the pair of central first panels; and at least one of the third panels located between the second end first panel and the pair of central first panels.

Exemplary Claim 13. The ceiling system according to claim 12 wherein the third panels comprise: a first pair of the third panels adjacent one another and located between the first end first panel and the pair of central first panels; and a second pair of the third panels adjacent one another and located between the second end first panel and the pair of central first panels.

Exemplary Claim 14. The ceiling system according to any one of claims 1 to 13 wherein the first top edges and the second top edges are substantially flush with one another at the primary intersection nodes and the second top edges and the third top edges are substantially flush with one another at the secondary intersection nodes.

Exemplary Claim 15. The ceiling system according to any one of claims 1 to 14 wherein each of the first, second, and third bottom edges are curvilinear.

Exemplary Claim 16. The ceiling system according to any one of claims 1 to 15 wherein each of the first, second, and third top edges are linear.

Exemplary Claim 17. The ceiling system according to any one of claims 1 to 16 wherein the hanging hardware comprises tensile members having first ends coupled to the support structure and second ends coupled to the first panels.

Exemplary Claim 18. The ceiling system according to any one of claims 1 to 17 wherein the second and third panels are free of any hanging hardware or other direct connections to the support structure.

Exemplary Claim 19. The ceiling system according to any one of claims 1 to 18 wherein the open cell grid structure is a rectilinear grid having open cells of equal cross-sectional area.

Exemplary Claim 20. The ceiling system according to any one of claims 1 to 18 wherein the open cell grid structure is hung from the support structure solely by the hanging hardware that is connected to the first panels.

Exemplary Claim 21. A method of installing a ceiling system in a building, the method comprising: hanging a plurality of first panels in a non-intersecting arrangement from an overhead support with hanging hardware, each of the first panels having a first top edge, a first bottom edge, and a plurality of first upper slots in the first top edge, the first bottom edges facing downward; mounting a plurality of second panels to the first panels in a first intersecting arrangement by mating second lower slots of the second panels with the first upper slots of the first panels to form primary intersection nodes, the second lower slots formed in second bottom edges of the second panels that face downward; and mounting a plurality of third panels to the second panels in a second intersecting arrangement by mating third lower slots of the third panels with second upper slots of the second panels to form secondary intersection nodes, the third lower slots formed in third bottom edges of the third panels that face downward, and the second upper slots formed in second top edges of the second panels, thereby forming an open cell grid structure that hangs in an occupied space of the building.

Exemplary Claim 22. The method according to claim 21 wherein the second panels are supported in the open cell grid structure solely due to the mating between the first and second panels at the primary intersection nodes.

Exemplary Claim 23. The method according to any one of claims 21 to 22 wherein the third panels are supported in the open cell grid structure solely due to the mating between the second and third panels at the secondary intersection nodes.

Exemplary Claim 24. The method according to any one of claims 21 to 23 further comprising: wherein step b) further comprises mating the second lower slots of the second panels with the first upper slots of the first panels so that the first bottom edges and the second bottom edges are substantially flush with one another at the primary intersection nodes; and wherein step c) further comprises mating the third lower slots of the third panels with the third upper slots of the third panels so that the third bottom edges and the second bottom edges are substantially flush with one another at the secondary intersection nodes.

Exemplary Claim 25. The method according to claim 24 further comprising: wherein step b) further comprises mating the second lower slots of the second panels with the first upper slots of the first panels so that floors of the second lower slots abut floors of the first upper slots; and wherein step c) further comprises mating the third lower slots of the third panels with the third upper slots of the third panels so that floors of the third lower slots abut floors of the second upper slots.

Exemplary Claim 26. The method according to any one of claims 21 to 25 further comprising: wherein step b) further comprises mating the second lower slots of the second panels with the first upper slots of the first panels so that the first top edges and the second top edges are substantially flush with one another at the primary intersection nodes; and wherein step c) further comprises mating the third lower slots of the third panels with the third upper slots of the third panels so that the third top edges and the second top edges are substantially flush with one another at the secondary intersection nodes.

Exemplary Claim 27. The method according to any one of claims 21 to 26 wherein the first panels are free of any slots on the first bottom edges, and the third panels are free of any slots on the third top edges; and wherein the second and third panels are free of any hanging hardware or other direct connections to the support structure.

Exemplary Claim 28. The method according to any one of claims 21 to 27 further comprising: wherein step c) further comprises mounting the third panels to the second panels so that the third panels do not intersect the first panels.

Exemplary Claim 29. The method according to any one of claims 21 to 27 further comprising: wherein step a) further comprises hanging a first end first panel, a second end first panel, and at least one central first panel between the first and second end first panels from the support structure; and wherein step c) further comprises: mounting at least one of the third panels to the second panels between the at least one central first panel and the first end first panel; and mounting at least one of the third panels to the second panels between the at least one central first panel and the second end first panel.

Exemplary Claim 30. The method according to claim 29 further comprising: wherein step a) further comprises hanging a pair of the central first panels adjacent one another and between the first and second end first panels from the support structure, wherein a first distance exists between the pair of the central first panels and a second distance exists between the first end first panel and the pair of the central first panels and between the second end first panel and the pair of the central first panels, the second distance being greater than the first distance; and wherein step c) further comprises a first pair of the third panels to the second panels between the pair of the central first panel and the first end first panel; and mounting a second pair of the third panels to the second panels between the pair of the central first panels and the second end first panel.

Exemplary Claim 31. The method according to any one of claims 21 to 30 further comprising: wherein step a) further comprises hanging the plurality of first panels from the overhead support with the hanging hardware so that the first panels are substantially parallel to one another; and wherein step c) further comprises mounting the third panels to the second panels so that the third panels are substantially parallel to the first panels.

Exemplary Claim 32. The method according to any one of claims 21 to 31 wherein the first, second, and third panels are rigid panels.

Exemplary Claim 33. The method according to any one of claims 21 to 33 wherein the first, second, and third panels are acoustic panels.

Exemplary Claim 34. The method according to any one of claims 21 to 33 wherein upon completion of step b) the second panels are maintained in the open cell grid structure solely by gravity; and wherein upon completion of step c) the second panels are maintained in the open cell grid structure solely by gravity.

Exemplary Claim 35. The method according to any one of claims 21 to 34 wherein the first, second, and third panels have a panel thickness; and wherein the first upper slots, the second lower slots, the second upper slots, and the third lower slots have a slot width, the slot width being greater than the panel thickness.

Exemplary Claim 36. The method according to any one of claims 21 to 35 further comprising: wherein step a) further comprises hanging each one of the first panels with at least two tensile members, each tensile member having a first end coupled to the support structure and a second end coupled to the first panels.

Exemplary Claim 37. The method according to any one of claims 21 to 36 wherein each of the first, second, and third bottom edges are curvilinear; and wherein each of the first, second, and third top edges are linear.

Exemplary Claim 38. The method according to any one of claims 21 to 37 wherein the open cell grid structure comprises open cells of equal cross-sectional area.

Exemplary Claim 39. The method according to any one of claims 21 to 38 wherein the open cell grid structure is hung from the support structure solely by the hanging hardware that is connected to the first panels.

What is claimed is:

1. A ceiling system comprising:

an open cell grid structure comprising:

a plurality of first panels, each of the first panels having a first top edge, a first bottom edge, and a plurality of first upper slots in the first top edge, the first panels arranged in a non-intersection arrangement so that the first bottom edges face downward, wherein each of the plurality of first panels are a one-piece construction;

a plurality of second panels, each of the second panels having a second top edge, a second bottom edge, a plurality of second upper slots in the second top edge, and a plurality of second lower slots in the second bottom edge that are offset from the second upper slots, the second panels mounted to the first panels in a first intersecting arrangement so that the second lower slots mate with the first upper slots to form primary intersection nodes, the second bottom edges facing downward; and a plurality of third panels, each of the third panels having a third top edge, a third bottom edge, and a plurality of third lower slots in the third bottom edge, the third panels mounted to the second panels in a second intersecting arrangement so that the third lower slots mate with the second upper slots at secondary intersection nodes, the third bottom edges facing downward;

hanging hardware connected to each of the first panels and to a support structure to hang the open cell grid structure from the support structure in an occupied space of a building; and wherein the plurality of first panels has a first height as measured between the first top edge and the first bottom edge, the plurality of second panels has a second height as measured between the second top edge and the second bottom edge, and the plurality of third panels has a third height as measured between the third top edge and the third bottom edge; and wherein at least one of the first height, the second height, and the third height varies along a length of the respective panel.

2. The ceiling system according to claim 1 wherein the second panels are supported in the open cell grid structure solely due to the mating between the first and second panels at the primary intersection nodes.

3. The ceiling system according to claim 1, wherein the third panels are supported in the open cell grid structure solely due to the mating between the second and third panels at the secondary intersection nodes.

4. The ceiling system according to claim 1, wherein the first bottom edges and the second bottom edges are substantially flush with one another at the primary intersection nodes and the second bottom edges and the third bottom edges are substantially flush with one another at the secondary intersection nodes.

5. The ceiling system according to claim 1, further comprising:

the first, second, and third panels have a panel thickness; and the first upper slots, the second lower slots, the second upper slots, and the third lower slots have a slot width, the slot width being greater than the panel thickness.

6. The ceiling system according to claim 1, further comprising:

the first panels comprising:

a first end first panel;

a second end first panel; and a pair of central first panels adjacent one another and located between the first and second end first panels; and the third panels comprising:

at least one of the third panels located between the first end first panel and the pair of central first panels; and at least one of the third panels located between the second end first panel and the pair of central first panels.

7. The ceiling system according to claim 6 wherein the third panels comprise: a first pair of the third panels adjacent one another and located between the first end first panel and the pair of central first panels; and a second pair of the third panels adjacent one another and located between the second end first panel and the pair of central first panels.

8. The ceiling system according to claim 1, wherein the first top edges and the second top edges are substantially flush with one another at the primary intersection nodes and the second top edges and the third top edges are substantially flush with one another at the secondary intersection nodes.

9. A method of installing a ceiling system in a building, the method comprising:

a) hanging a plurality of first panels in a non-intersecting arrangement from an overhead support with hanging hardware, each of the first panels having a first top edge, a first bottom edge, and a plurality of first upper slots in the first top edge, the first bottom edges face downward, wherein each of the plurality of first panels are a one-piece construction, wherein the hanging hardware is attached directly to each of the plurality of first panels;

b) mounting a plurality of second panels to the first panels in a first intersecting arrangement by mating second lower slots of the second panels with the first upper slots of the first panels to form primary intersection nodes, the second lower slots formed in second bottom edges of the second panels that face downward; and c) mounting a plurality of third panels to the second panels in a second intersecting arrangement by mating third lower slots of the third panels with second upper slots of the second panels to form secondary intersection nodes, the third lower slots formed in third bottom edges of the third panels that face downward, and the second upper slots formed in second top edges of the second panels, thereby forming an open cell grid structure that hangs in an occupied space of the building;

wherein a lower surface of the open cell grid structure is curved.

10. The method according to claim 9 wherein the second panels are supported in the open cell grid structure solely due to the mating between the first and second panels at the primary intersection nodes and wherein the third panels are supported in the open cell grid structure solely due to the mating between the second and third panels at the secondary intersection nodes.

11. The method according to claim 9, further comprising:

wherein step b) further comprises mating the second lower slots of the second panels with the first upper slots of the first panels so that the first bottom edges and the second bottom edges are substantially flush with one another at the primary intersection nodes; and wherein step c) further comprises mating the third lower slots of the third panels with the second upper slots of the second panels so that the third bottom edges and the second bottom edges are substantially flush with one another at the secondary intersection nodes.

12. The method according to claim 11 further comprising:

wherein step b) further comprises mating the second lower slots of the second panels with the first upper slots of the first panels so that floors of the second lower slots abut floors of the first upper slots; and wherein step c) further comprises mating the third lower slots of the third panels with the second upper slots of the second panels so that floors of the third lower slots abut floors of the second upper slots.

13. The method according to claim 9, further comprising:

wherein step b) further comprises mating the second lower slots of the second panels with the first upper slots of the first panels so that the first top edges and the second top edges are substantially flush with one another at the primary intersection nodes; and wherein step c) further comprises mating the third lower slots of the third panels with the second upper slots of the second panels so that the third top edges and the second top edges are substantially flush with one another at the secondary intersection nodes.

14. The method according to claim 9, further comprising:

wherein step a) further comprises hanging a first end first panel, a second end first panel, and at least one central first panel between the first and second end first panels from the support structure; and wherein step c) further comprises: mounting at least one of the third panels to the second panels between the at least one central first panel and the first end first panel; and mounting at least one of the third panels to the second panels between the at least one central first panel and the second end first panel.

15. The method according to claim 14 further comprising:

wherein step a) further comprises hanging a pair of the central first panels adjacent one another and between the first and second end first panels from the support structure, wherein a first distance exists between the pair of the central first panels and a second distance exists between the first end first panel and the pair of the central first panels and between the second end first panel and the pair of the central first panels, the second distance being greater than the first distance; and wherein step c) further comprises a first pair of the third panels to the second panels between the pair of the central first panel and the first end first panel; and mounting a second pair of the third panels to the second panels between the pair of the central first panels and the second end first panel.

16. The method according to claim 9, wherein upon completion of step b) the second panels are maintained in the open cell grid structure solely by gravity; and wherein upon completion of step c) the second panels are maintained in the open cell grid structure solely by gravity.

17. The method according to claim 9, wherein the first, second, and third panels have a panel thickness; and wherein the first upper slots, the second lower slots, the second upper slots, and the third lower slots have a slot width, the slot width being greater than the panel thickness.

18. A ceiling system comprising:

an open cell grid structure comprising:

a plurality of first panels, each of the first panels having a first top edge, a first bottom edge, and a plurality of first upper slots in the first top edge, the plurality of first slots having a first upper slot height;

a plurality of second panels, each of the second panels having a second top edge, a second bottom edge, a plurality of second upper slots in the second top edge, and a plurality of second lower slots in the second bottom edge that are offset from the second upper slots, the plurality of second upper slots having a second upper slot height and the plurality of second lower slots having a second lower slot height; and a plurality of third panels, each of the third panels having a third top edge, a third bottom edge, and a plurality of third lower slots in the third bottom edge, the plurality of third lower slots having a third lower slot height, wherein the first panels and second panels are mounted together in a first intersecting arrangement and the second panels and third panels are mounted together in a second intersecting arrangement; and wherein each of the first upper slot heights of the plurality of first upper slots are equal to each other, and wherein the plurality of second lower slot heights of the second lower slots vary.

19. The ceiling system according to claim 18, wherein each of the second upper slot heights of the plurality of second upper slots are equal to each other and wherein each of the plurality of third lower slot heights of the third lower slots vary.

20. The ceiling system according to claim 18, wherein each of the second panels comprises a first side edge, a second side edge, and a second panel axis extending between the first and second side edges, and wherein one or more of the second lower slots in the second bottom edge of the second panels is located between two adjacent ones of the second upper slots in the second top edge of the second panels in a direction of the second panel axis.

* * * * *